United States Patent [19]

O'Hare

[11] 4,451,037

[45] May 29, 1984

[54] MOBILE PUSHING EXERCISER

[76] Inventor: Thomas J. O'Hare, 81 Thornton Dr., Chalmette, La. 70043

[21] Appl. No.: 239,651

[22] Filed: Mar. 2, 1981

[51] Int. Cl.[3] ..... A63B 67/00

[52] U.S. Cl. ..... 273/55 R; 272/142; 272/132; 272/DIG. 5; 73/380

[58] Field of Search ..... 273/55 R, 55 A; 73/379–381; 272/DIG. 5, 132, 142

[56] References Cited

U.S. PATENT DOCUMENTS

| | | | |
|---|---|---|---|
| 3,062,548 | 11/1962 | Forrest et al. | 273/55 R |
| 3,326,553 | 6/1967 | Forrest | 273/55 R |
| 3,572,699 | 3/1971 | Nies | 273/55 R |
| 3,643,943 | 2/1972 | Erwin, Jr. et al. | 272/DIG. 5 |
| 3,889,948 | 6/1975 | Visco | 273/55 R |
| 3,897,060 | 7/1975 | Jennings | 273/55 R |

*Primary Examiner*—Richard C. Pinkham
*Assistant Examiner*—T. Brown
*Attorney, Agent, or Firm*—Bode & Smith

[57] ABSTRACT

A three wheeled mobile pushing exerciser with an adjustable braking system and a chart recording mechanism, said exerciser intended for the development and analysis of an athlete's pushing power in a program of physical exercise related to dynamic sports such as football. Handle bars are slidably mounted onto the wheel assembly of the exerciser and provided with a means for measuring the pushing force applied to the handle bars when the exerciser is pushed forward. An adjustable braking system is used in conjunction with the rear wheel assembly to provide a method for varying the resistance of the exerciser to pushing movement applied to the exerciser. A drive screw, stylus, and chart are fixedly attached to the exerciser to provide for measurement of the distance travelled by the pushing exerciser. A stopwatch is fixedly mounted on the exerciser and is activated and deactivated by the forward and rearward sliding of the handle bars so that the time that the exerciser is in motion may also be recorded.

4 Claims, 6 Drawing Figures

MOBILE PUSHING EXERCISER

BACKGROUND OF THE INVENTION

Figure 1:
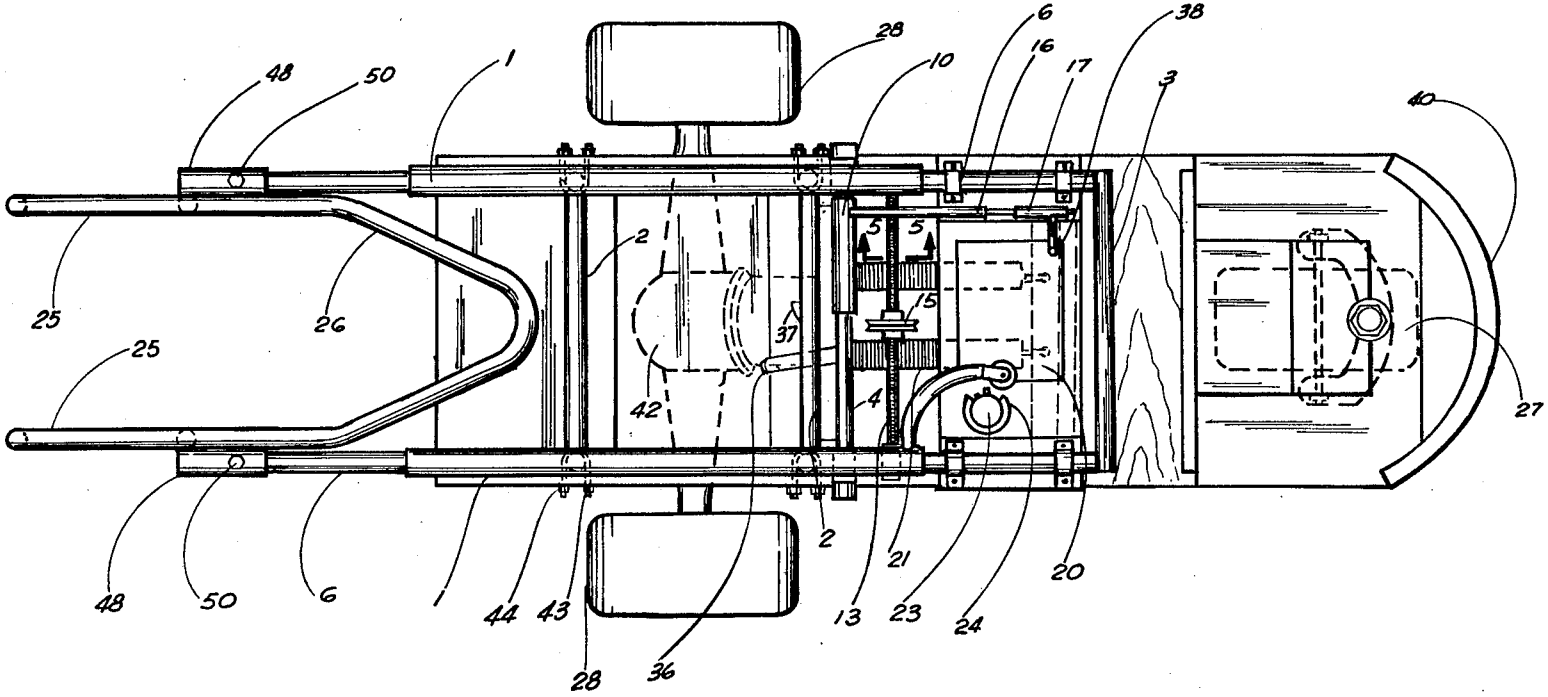

Most researched devices in the background seemed to be patterned after the conventional blocking sled, a device which is equipped with skids and designed to slide along the ground frictionally, with pushing resistance roughly regulated by the amount of ballast added to the device. Several stationarily mounted devices were noticed which did register force, but this was the force of a single blocking impact and not related to a retreating vehicle over an extended distance. One device was mounted on a skid and two rubber tire wheels, with pushing resistance in its case being provided by a rider-operated braking system, but it too was of different object and embodiment from the invention. All devices reviewed seemed to invite impact engagement and were equipped with padded emplacements seemingly receptive to such engagement.

The instant invention by contrast is meant for a relatively smooth-starting exercise from a get-set, pre-engaged position in which horizontal force is applied by the hands against steel bars, instead of by the shoulders against a padded emplacement. The invention is intended more for extended pushing exercises up to eighty feet, in which endurance becomes a factor of performance. The invention incorporates a highly sensitive and adjustable brake to regulate pushing resistance in a consistent and measurable manner. The invention is equipped with a chart recording mechanism to produce a work diagram capable of translation into foot-lbs. Since rate of work performance is an important consideration, the time in seconds is simultaneously measured. With the factors of force, distance and time, thus recorded, the calculation of an athlete's horsepower becomes simple and routine. These and other features of the invention will be explained in greater detail as the disclosure progresses.

OBJECT OF THE INVENTION

The general object of the invention is to provide an exercise device for developing the pushing power of an athlete, and to equip said device with a means of measuring and recording performance values related to the pushing exercise. More specifically, an object of the invention is to provide a precise and consistent means of regulating pushing resistance and thus make the resulting exercise progressive and measurable.

Another object of the present invention is to provide a means of measuring pushing force.

Another object of the present invention is to provide a means of recording said pushing force on a chart.

Another object is to provide a means of measuring pushing distance.

Another object of the present invention is to provide a means of recording said pushing distance on a chart.

Still another object of the present invention is to provide a means of mechanically measuring the duration of a pushing exercise.

And another object of the present invention is to provide a means of measuring work performed during a pushing exercise.

Another object of the present invention is to provide a means to produce data for calculating the horsepower of a trainee as related to a pushing exercise.

Another object of the present invention is to provide a means to produce data on a trainee with sufficient accuracy and consistency to be used for evaluation of a trainee's progress, and for comparison of said data with that of competing trainees.

Another object of the present invention is to provide a device capable of universal usage in rating the pushing power of people in general.

Another object of the present invention is to provide a pushing device mobilly adaptable to most floors, roadways and turf surfaces without damage either to the surface in question or to the pushing device itself.

NOMENCLATURE OF THE INVENTION - BRIEF REFERENCE TO DRAWINGS

FIG. 1 is a top assembly view in which the uppermost features of the invention are visible. This includes the pushing bars 25 and V-shaped unitizing bar 26, the guided pushing assembly bars 6, the chartboard 20, the two pushing assembly guides 1, the stopwatch 23 and stopwatch socket 24, the stopwatch actuating roller 22, the stylus drive screw 13 and pulley 15, the stylus follower arm 16, the stylus wrist joint 17, the pencil holder 38, the brake release lever 36 and its catch 37, and a partial view of the force-measuring springs 21.

Figure 2:
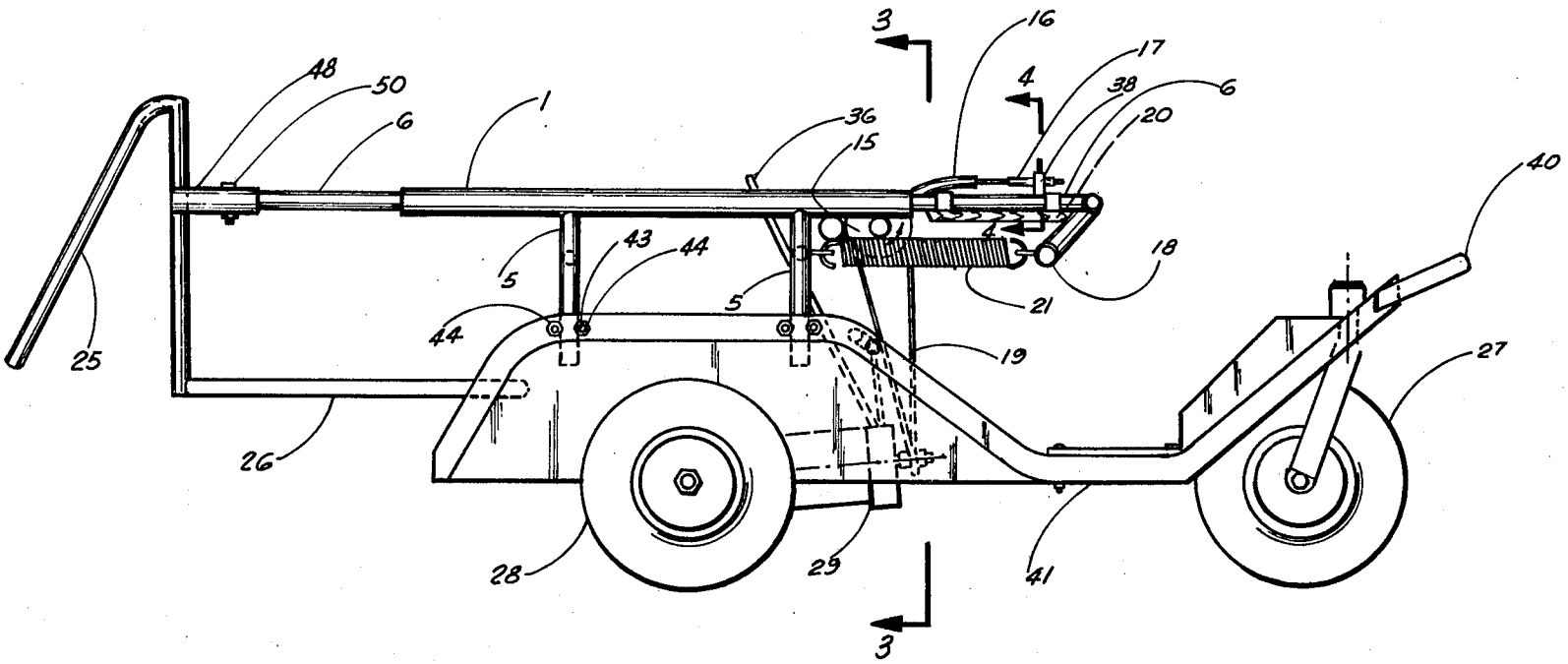

FIG. 2 is a side elevation view of the invention assembly which shows principally the pushing bars 25, the pushing assembly 3,6,7, and 18, an edge view of the chartboard 20, one of the two calibrated force-measuring springs 21, the stylus drive screw drive belt 19, the brake release lever 36, the stylus follower arm 16, the stylus wrist joint 17 and the stylus pencil holder 38. Also shown are the right rear wheel 28 and the free-swiveling front wheel 27.

Figure 3:
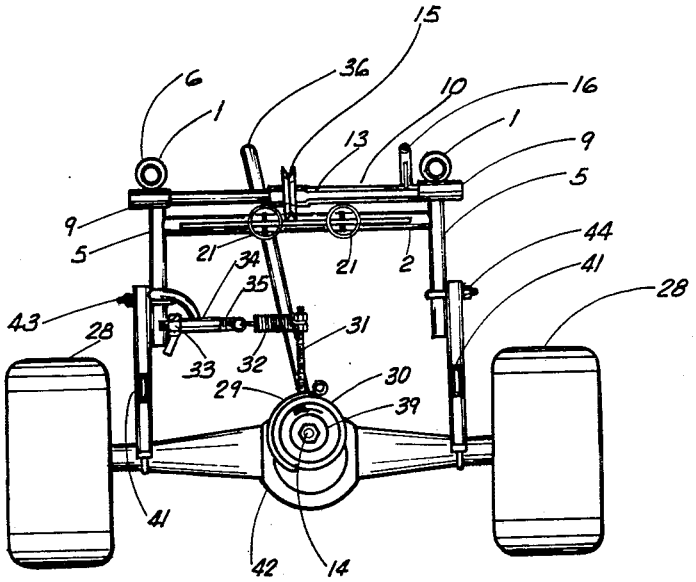

FIG. 3 is a transverse section view of the vehicle assembly in which attention is drawn principally to the adjustable braking system, said system consisting of the brake drum 30, the brake shoe 29, the brake shoe actuating arm 31, the brake shoe pressure control or monitoring spring 32, the brake pressure adjusting screw 35 and nut 33, and the brake adjusting screw mounting sleeve 34. Also shown are the stylus drive screw 13 and the integral pulley 15, the two stylus drive screw carrier bearings 9, the stylus drive screw follower arm 16, and a sectional view of the two force-measuring springs 21.

Figure 4:
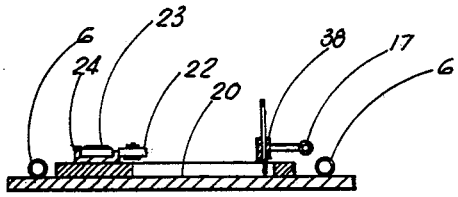

FIG. 4 is a transverse sectional view of the chartboard assembly taken through the pencil holder, and through the forward portions of chartboard and pushing assembly. In this view is shown the chartboard 20, the stopwatch 23 and the stopwatch socket 24, the stopwatch actuating roller 22, the stylus wrist joint 17, the pencil holder 38, and the guided bars 6 of the pushing assembly. Also shown is the chart well in which the chart is positioned and held, without adhesives or tacks, by protective runners.

Figure 5:
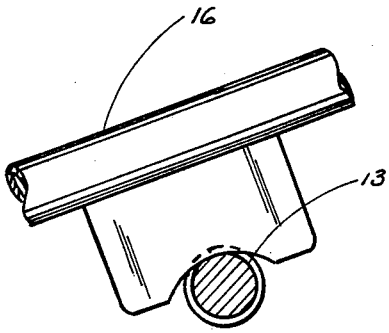

FIG. 5 is a sectional view of the stylus drive screw 13, detailing the engagement of follower arm 16 with said drive screw 13.

Figure 6:
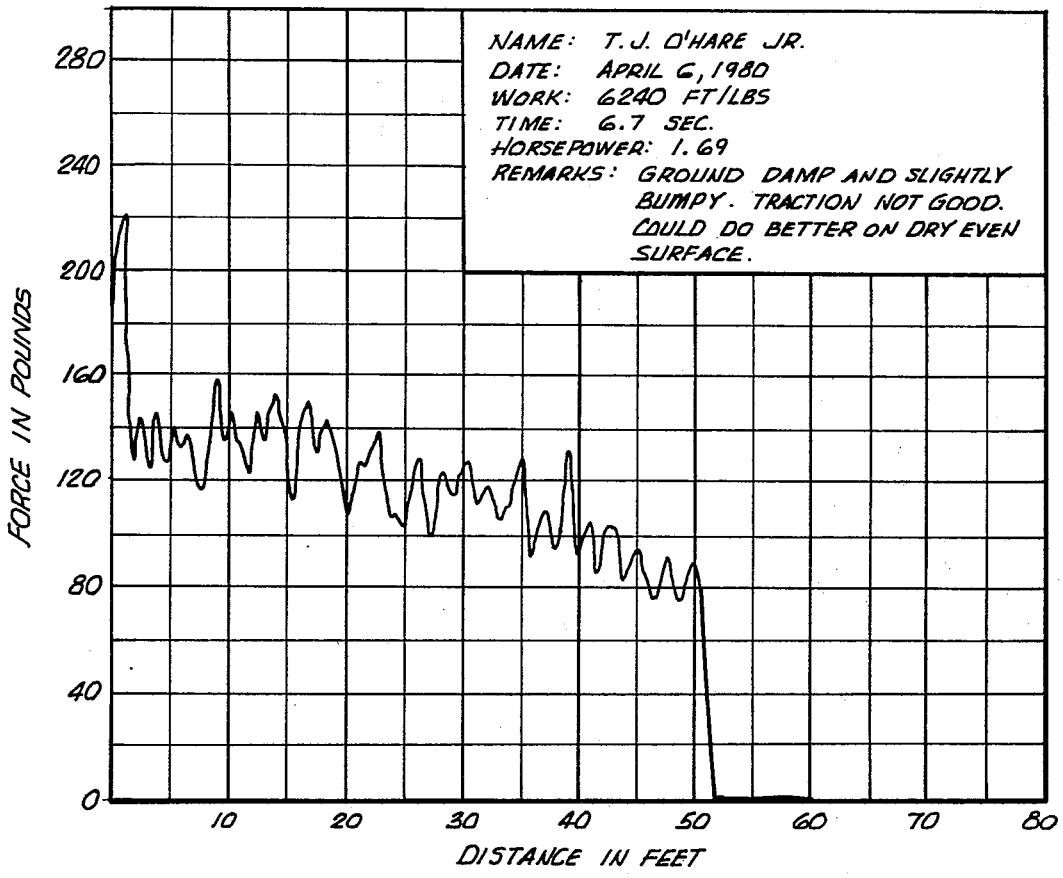

FIG. 6 is a scaled down reproduction of a typical chart as produced by the invention.

OPERATION OF INVENTION - DETAILED REFERENCE TO DRAWINGS

The exercising subject, or trainee as he will be referred to in this disclosure, will grasp the hand bars 25, and test the invention by pushing same twenty to thirty feet to get the feel for the overall force required to overcome brake resistance, plus the natural inertia and rolling resistance of the invention. Trainee will increase or decrease brake resistance by turning eccentrically weighted nut 33 clockwise to increase tension and counterclockwise to reduce tension in spring 32, which spring transmits force to brake shoe 29 through brake shoe actuating arm 31, and hence produces a braking effect, between brake show 29 and brake drum 30, proportional to tension in said spring 32.

If necessary to re-position invention for another run, brake release lever 36 may be cocked back over catch 37 and thus retract brake shoe 29 away from brake drum 30, producing a free-wheeling condition in vehicle, which condition may be used for more easily maneuvering invention for start of an exercise run, or for free movement of invention over longer distances, but excluding motorized towing at any speed.

After assessing his capability with said test run of twenty or thirty feet, and after having adjusted brake resistance to said capability, trainee will commence a measured pushing exercise.

Upon a steadily applied pushing force, invention vehicle and its components will react movingly as per the following description: Pushing bars 25, V-shaped unitizing bar 26, and whole pushing carriage consisting of guided bars 6, transverse unitizing bar 3, force-measuring spring 21, chartboard 20, stopwatch 23 and socket 24 will all deflect forward relative to vehicle, extent of said deflection depending upon the amount of force exerted by trainee and by the amount of resistance set into aforementioned adjustable brake.

At the same time, though in a nondeflecting mode, the stopwatch actuating roller 22, the stylus follower arm 16, the stylus wrist joint 17, and the stylus pencil holder 38 mechanically participate in the measuring and recording of pushing values by their respective stationary relationship to said deflecting components, said relationship to be unfolded in the continuing description.

Pushing force is measured by the calibrated deflection of springs 21, said force being recorded by relative movement of chartboard 20 in a manner as to produce a longitudinal component in the scribing action of a pencil or thin ballpoint pen in holder 38. Thus, in this instance, the chart deflects longitudinally and the writing stylus, including said holder 38, remain longitudinally stationary.

The distance traveled by invention during same pushing exercise is measured by a calibrated stylus drive screw 13, which screw and associated pulley 15 are driven by a belt 19, said belt itself being driven by another pulley 39, said other pulley 39 being mounted on and turning in unison with longitudinal shaft 14, on which brake drum 30 is adjacently mounted, said shaft 14 being driven through differential 42 at a specified ratio by rear wheels 28.

Now relating back to stylus drive screw 13, said screw rotating at a prescribed ratio to rear wheels 28 and hence related to distance traveled by invention vehicle. Said screw 13 is rested upon in its thread groove by a knife-edged follower, which follower forming the underpart of stylus follower arm 16, said arm and follower being driven transversely by said rotating screw 13, thus imparting a transverse component to movement of pencil in aforementioned holder 38, which transverse component of stylus movement is proportional to distance traveled by invention vehicle during a measured pushing exercise.

Calling attention now to the after-portion of stylus follower-arm 16 where said arm connects with stylus carriage sleeve 10, which sleeve is slidingly engaged with stylus carriage guide bar 4, said items 4 and 10 supplying a smooth guidance to transverse movement of said stylus. The stylus wrist joint 17 is free to pivot in allowance of a limited up and down adaptation of pencil holder 38 to vibration in stylus follower arm 16 and yet maintain a proper and constant scribing pressure on chart by pencil or ball-point pen in holder 38.

Steering of invention vehicle, while said vehicle is in motion, is accomplished by the application of a moderate lateral component of force on pushing bars 25 by the trainee during the pushing exercise. Heading of said invention vehicle into a given direction, while vehicle is essentially stationary, is accomplished similarly by the application of a lateral force on pushing bars 25, though said force in this case is slightly greater than the force required for steering a moving invention vehicle.

The said maneuvers of steering or heading of invention vehicle by the application of said lateral force components on pushing bars, is facilitated by the operation of freeswiveling front wheel 27, which same front wheel is also capable of tracking smoothly once vehicle movement has been established in a given direction. Attention is called even more closely to same wheel 27 in which it will be seen that a caster effect has been established by the designed offset of the wheel-to-ground contact, relative to the point where projection of steering axis intersects ground.

Referring once again to the area of the pushing bars in which said hand bars 25 are the most prominent elements, the presence of two mounting sockets 48 which facilitates detachment of pushing bar assembly from said pushing assembly guided bars 6, is essential to the practical maintenance and adjustment of said pushing assembly. Aforementioned sockets 48 telescope snugly over items 6 and are pinned to same items 6 by removable bolts 50. Another important element in the pushing area is V-shaped unitizing bar 26, which holds said items 25 rigidly in place. Same item 26 also assists in holding a proper lateral spacing of items 6 in a sliding relationship with guiding items 1.

The guiding and guided relationship of said items 1 and 6 respectively, exists as one round tube within another, with close but sufficient allowance between outer guides 1 and the inner or guided members 6 to insure free-sliding contact between said members 1 and 6 during operation of invention.

Referring again in detail to differential 42, said differential of a light automotive type allowing independent rotation of wheels 28 as in making a tight turn, this same feature assuring full credit to trainee for distance traveled in a pushing exercise, though path of said exercise might be curved. Said longitudinal shaft 14, which transmits rotation from differential 42, terminates on the forward end in a threaded projection, upon which pulley 39 is mounted and held integral with shaft 14 by two locknuts. Said pulley 39 drives aforementioned other pulley 15 by means of belt 19, said belt 19 being twisted 90 degrees in the horizontal plane in adaptation to the right-angle relationship between the driving member 14 and the driven stylus drive screw 13.

The measurement of time, as it relates to the duration of a pushing exercise, is accomplished by the engaging passage of stopwatch 23 and its exposed stem, past a nondeflecting roller 26 in such a way as to depress watchstem and thus activate said stopwatch at the start of a pushing exercise, and to again depress said watch stem at the completion of same pushing exercise as said pushing carriage moves back toward an at-rest position, said restoring movement resulting when springs 21 kinetically expand themselves of mechanical energy stored therein during the active phase of the pushing exercise.

A study of the general embodiment of the invention, as pictured in FIG. 2, will reveal an upper structure of previously detailed tubular members supported by four tubular legs 5, said legs 5 being clamped to frame 41 of basic vehicle by four U-bolts 43 and associated nuts 44. Said U-bolt clamps permit a degree of height adjustment of the upper structure, as well as facilitate the complete removal of said upper structure from the chassis. Curved bar 40, on front end of invention vehicle, is primarily a bumper, but may also be used in loading and unloading invention, said other use of item 40 involving attachment thereto of winch hooks in the pulling of invention up a loading ramp into a transport vehicle.

In examination of FIG. 6, which is a reduced reproduction of a typical chart drawn mechanically by invention vehicle, it will be noticed that the vertical axis represents force, and the horizontal axis represents distance. In the example graph itself, a sudden upward surge in force value at the very onset of the exercise indicates the presence of static inertia in the vehicle, which inertia quickly dissipates as vehicle accelerates and acquires kinetic energy. With vehicle now in motion the force value reduces to the figure required to keep invention vehicle in motion against the frictional drag of said adjustable brake, and against the natural rolling friction of the vehicle itself. As the pushing exercise continues, a gradual tapering off in force indicates that trainee is tiring. The degree of steepness of said graph from left to right is indicative of the tiring rate. It will be noted also that graph line has an additional, more closely spaced wavy characteristic, said characteristic caused by the reaction of said pushing carriage to each pushing stroke of the legs. Closer examination of said smaller waves in the graph in a measured comparison with the horizontal axis reveals the trainee's length of stride. The measured comparison of said smaller waves with the vertical axis indicates the relative force of each pushing stroke of the legs as applied by trainee. The area within the charted figure, as bounded by the vertical axis on the left, by the horizontal axis on the bottom and by the graph line on the top and right hand side of the figure, is indicative of the work in footpounds performed by trainee in said pushing exercise. Horsepower of trainee can now be calculated by dividing said work in foot-pounds by the time in seconds of exercise duration, as measured by aforementioned stopwatch, and then dividing the resulting quotient by a factor of five hundred and fifty. In pushing tests made thus far of adult males, said horsepower has ranged from 0.8 to 1.8 for relatively untrained subjects, and from 1.41 to 2.39 for professional football linemen. Said tests were run at several brake settings, and over distances ranging from forty to sixty feet. Times ranged from 5.9 seconds to 9.2 seconds.

What is claimed as invention is:

1. A mobile pushing exerciser, which comprises:

a. a pushing carriage, said carriage being mounted on a wheel assembly; moveable along the ground;

b. means for providing a variable resistance to the movement of said pushing exerciser;

c. means for measuring pushing force when said pushing exerciser is manually moved along the ground, said means comprising:

i. at least one hand bar mounted on said pushing carriage for manually propelling said pushing exerciser along the ground when force is applied to said hand bar;

ii. means providing slidable engagement of said carriage on said exerciser allowing forward and backward slidable movement of said carriage relative to said exerciser when pushing force is applied to said carriage;

iii. means for restraining forward sliding movement of said carriage when said pushing force is applied thereto;

iv. a surface area rigidly connected to said carriage for receiving a chart thereonto, said surface being substantially parallel with the ground;

v. follow arm means moveable in a transverse direction for recording on said chart pushing force causing movement of said carriage when said exerciser is propelled forward;

d. means for measuring distance travelled by said pushing exerciser, wherein said means comprises;

i. a stylus drive screw rotatably mounted transverse to said carriage, said stylus drive screw allowing transverse movement of said follower arm means when said exerciser is moved longitudinally; and ii. means associated with said stylus drive screw for rotating said stylus drive screw when said carriage is moved longitudinally;

e. means for recording said distance; and f. means for measuring the duration of time that said pushing exerciser is manually pushed along the ground.

2. The apparatus in claim 1, wherein said wheel assembly further comprises a pair of rear wheels, and at least one free swivelling front wheel.

3. The apparatus of claim 1, wherein said means of measuring the duration of time the said exerciser is manually pushed along the ground comprises:

a. a stop-watch rigidly mounted to said carriage;

b. a means for activating said stop-watch when force is applied to said carriage;

c. a means for deactivating said stop-watch when said force is released from said carriage.

4. A mobile pushing exerciser which comprises:

a. a pushing carriage, said carriage being mounted on a wheel assembly said wheel assembly including a pair of axially mounted rear wheels, and at least one free swiveling front wheel, movable along the ground;

b. a pair of handle bars mounted on the rear of said carriage for receiving force against said carriage when said pushing exerciser is to be moved along the ground;

c. a braking system for providing variable resistance to the movement of said pushing exerciser, said braking system comprising:

i. a differential rotatably mounted on said rear wheels;

ii. a brake drum rotatably mounted to the output end of said differential for rotating when said differential is rotated as said pushing exerciser is moved along the ground;

iii. a brake shoe for imparting pressure against said brake drum, said brake drum movement being resisted as said brake shoe is frictionally against said brake drum;

iv. an arm integrally mounted to said brake shoe at a first end and interconnected to a variable spring means at a second end so that tension imparted upon said spring means increases the friction engagement between said brake shoe and said brake drum;

d. an assemblage for measuring and recording the pushing force when said pushing exerciser is manually moved along the ground, comprising:

i. a follower arm secured to a pencil or the like marking apparatus at a first end and rigidly attached to a collar at a second end, said collar movable along the width of said carriage;

ii. a stylus drive screw rotatably mounted perpendicular to said follower arm, and receiving an edge of said follower arm in the thread of said stylus drive screw, so that when said stylus drive screw is rotated, said follower arm is moved transversely along the width of said carriage;

iii. a pulley belt interconnecting the output portion of said differential to said stylus drive screw, so that rotation of said differential imparts rotation to said stylus screw;

iv. a surface for receiving chart paper or the like for producing markings thereupon when said pencil is mounted on said follower arm; and v. a stopwatch integrally attached to said carriage and actuated when said carriage is deflected forward by a pushing force, and deactivated when pushing force is removed and said carriage returns rearwardly to its at-rest position.

* * * * *